US012692762B2

(12) United States Patent
Stretch et al.

(10) Patent No.: US 12,692,762 B2
(45) Date of Patent: Jul. 28, 2026

(54) SHIFT SET PACKER

(71) Applicant: Schlumberger Technology Corporation, Sugar Land, TX (US)

(72) Inventors: Mitchel Stretch, Calgary (CA); Sean Borschneck, Calgary (CA); Sanjay Menon, Calgary (CA); Matthew McCarthy, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/880,987

(22) PCT Filed: Jul. 6, 2023

(86) PCT No.: PCT/US2023/026973

§ 371 (c)(1),
(2) Date: Jan. 3, 2025

(87) PCT Pub. No.: WO2024/010837

PCT Pub. Date: Jan. 11, 2024

(65) Prior Publication Data

US 2026/0002424 A1 Jan. 1, 2026

Related U.S. Application Data

(60) Provisional application No. 63/367,745, filed on Jul. 6, 2022.

(51) Int. Cl.
*E21B 33/128* (2006.01)
*E21B 23/06* (2006.01)

(52) U.S. Cl.
CPC ..... *E21B 33/128* (2013.01); *E21B 23/06* (2013.01)

(58) Field of Classification Search
CPC ..... E21B 23/06; E21B 33/128; E21B 33/134
See application file for complete search history.

(56) References Cited

U.S. PATENT DOCUMENTS

| | | | | |
|---|---|---|---|---|
| 2,274,940 | A | 3/1942 | Stoddard | |
| 3,382,927 | A * | 5/1968 | Davis, Jr. | E21B 23/01 166/134 |
| 5,311,938 | A * | 5/1994 | Hendrickson | E21B 33/1295 166/134 |
| 5,433,269 | A | 7/1995 | Hendrickson | |
| 2015/0300122 | A1* | 10/2015 | George | E21B 23/06 166/185 |
| 2021/0230962 | A1 | 7/2021 | Alders et al. | |

FOREIGN PATENT DOCUMENTS

| | | | | |
|---|---|---|---|---|
| WO | 2016118018 | A1 | 7/2016 | |
| WO | WO-2021080934 | A1 * | 4/2021 | E21B 33/1212 |

OTHER PUBLICATIONS

International Search Report and Written Opinion of International Patent Application No. PCT/US2023/026973 dated on Oct. 26, 2023, 11 pages.

* cited by examiner

*Primary Examiner* — Cathleen R Hutchins
(74) *Attorney, Agent, or Firm* — Kyle R. Miiller

(57) ABSTRACT

An apparatus and method of setting a packer assembly within a wellbore in a steam injection system. The packer assembly isolates portions of the wellbore. The packer assembly comprising a body. The body comprising a ramp and a sealing element positioned adjacent the ramp. A setting collet operable to force the sealing element along the ramp to expand the sealing element. A shear assembly shearable to unset the packer assembly.

20 Claims, 3 Drawing Sheets

SHIFT SET PACKER

CROSS-REFERENCE TO RELATED APPLICATION

The present document is a National Stage Entry of International Application No. PCT/US2023/026973, filed Jul. 6, 2023, which is based on and claims priority to U.S. Provisional Application Ser. No. 63/367,745, filed Jul. 6, 2022, which is incorporated herein by reference in its entirety.

BACKGROUND

Packers are used in bores, such as wellbores or tubular strings, to create temporary or permanent seals within the bores. A packer assembly may include one or more packing element. Forming seals may be part of wellbore operations at stages of drilling, completion, or production. The packers may be used for zonal isolation in which a zone or zones of a subterranean formation may be isolated from other zones of the subterranean formation or other subterranean formations. Packers may be to isolate any of a variety of inflow control devices, screens, or other such downhole tools that may be used in wellbores.

Packers are set hydraulically such as by dropping a ball on a seat and pressuring up the tubing causing the packer to set. Also, packers are set with setting tools that is run on wireline, slickline or coiled tubing that connects to the packer. The movement of the setting tool causes the packer to set.

Packers can be used in injection wells to create zones in a steam assisted gravity drainage (SAGD) system. SAGD is an example of steam injection that involves injecting steam from the surface into an injection horizontal well above a lower production horizontal well. The injected steam exits the injection well and create a steam chamber. The hydrocarbons are heated by the steam and thereby reduced in viscosity causing the hydrocarbons to drain downward by gravity into the production well. The hydrocarbons are conveyed to the surface in the production well.

SUMMARY

Embodiment disclosed herein relate to a packer assembly comprising a body. The body comprising a ramp and a sealing element positioned adjacent the ramp. A setting collet operable to force the sealing element along the ramp to expand the sealing element. A shear assembly shearable to unset the packer assembly.

In another aspect, embodiments relate to a method of setting a packer assembly within a wellbore. Shearing a shear assembly of the packer assembly to unset the packer.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
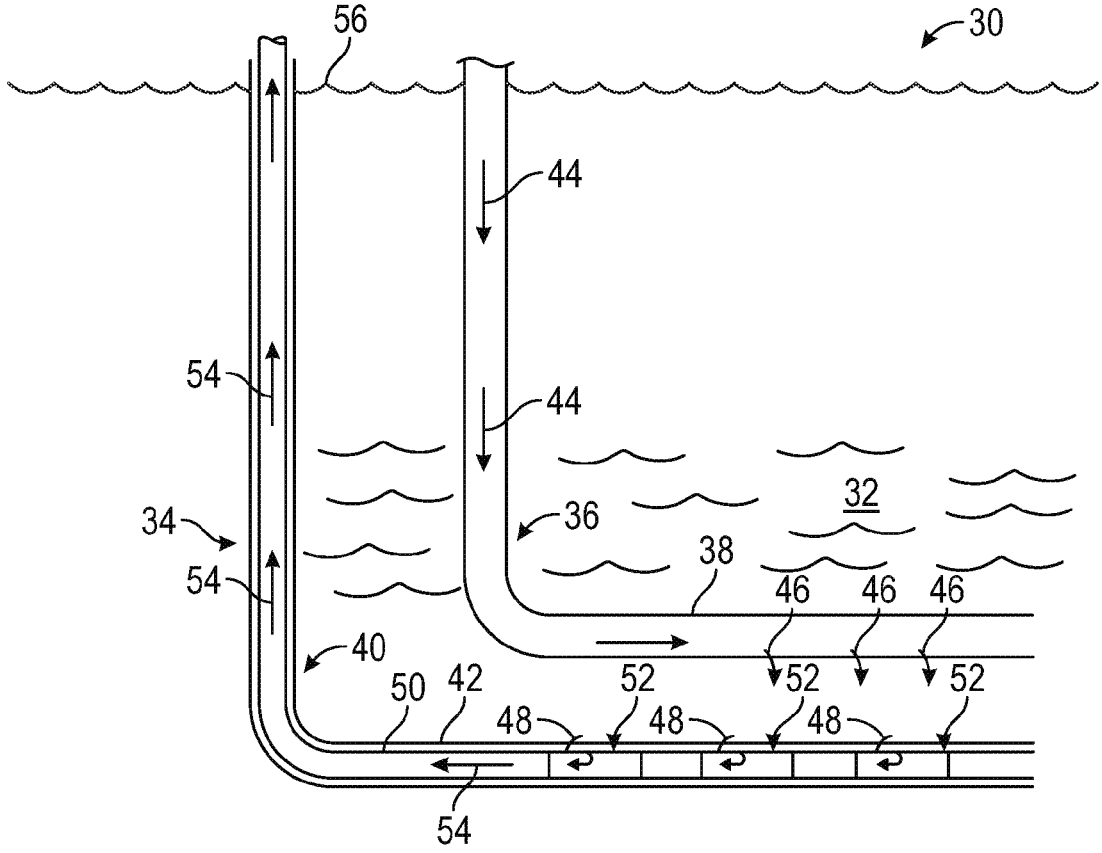
FIG. 1 is a well system comprising a SAGD system having an injector wellbore and a production wellbore.

Referring generally to FIG. 1, an example of a well system 30 is illustrated for use in producing a well fluid, e.g., oil, from a subterranean formation 32. In this example, the well system 30 comprises an SAGD system 34 having a steam injector well 36 with a generally lateral section of injector wellbore 38. The SAGD system 34 also comprises an oil production well 40 having a generally lateral section of production wellbore 42 which may be oriented generally parallel with and positioned below the corresponding lateral injector wellbore 38.

Steam, as represented by arrows 44, is directed down through appropriate injection equipment located in the steam injector well 36. During SAGD process, steam is circulated through the wellbore for a period of time prior to injecting steam into the reservoir. This is to heat up the near wellbore reservoir to effectively initiate the SAGD process. After the near wellbore reservoir has been heated, steam is injected into the surrounding formation 32 as represented by arrows 46. The high temperature steam reduces the viscosity of oil located in the surrounding formation 32 so the oil can flow down to the oil production well 40. The heated oil joins with the steam to form a well fluid in the form of an oil-water emulsion which flows at a high temperature and pressure as a front down to the producer well 40.

The well fluid enters the producer well 40 as represented by arrows 48. Specifically, the well fluid enters a completion string 50 located in the oil production well 40 via an inflow assembly or assemblies 52. As explained in greater detail below, each inflow assembly 52 comprises a plurality of inflow control devices which protect the completion equipment of completion string 50 by preventing influx of the high temperature steam. The well fluid is then able to flow up through completion string 50, as represented by arrows 54, to a desired collection location which may be at surface 56.

Figure 2:
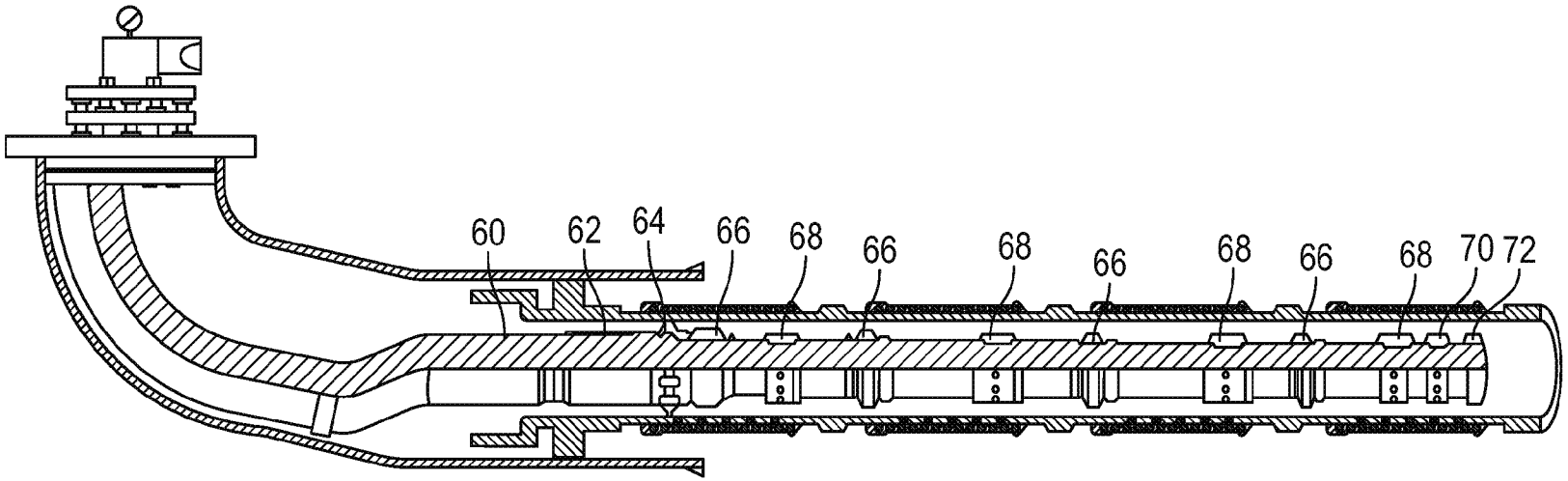
FIG. 2 is a schematic view of a steam injection system according to one or more embodiments of the present disclosure.

Turning now to FIG. 2, FIG. 2 is a schematic view of a steam injection system according to one or more embodiments of the present disclosure. The steam injection system includes a liner that is positioned within the wellbore. The liner is associated with a hanger 64 and a tieback 62. Additionally, the tieback 62 has a snap latch seal locator 60. The liner has bullnose 72. The bullnose 72 is a tool that guides the liner toward the center of the wellbore. Adjacent the bullnose 72 is a full flow sleeve 70 that allows fluid to flow through the full flow sleeve 70.

The liner includes multiple inflow control devices ("ICDs") 66 separated by packer assemblies 68 that enable isolation of different zones of the wellbore. The isolation of zones within the wellbore allows steam to be selectively delivered via the ICDs to different locations of the reservoir.

The ICD 66 control the rate at which the pressurized well fluid flows into the completion string 50. The completion string 50 includes ICD 66 that can be opened and closed to control flow of formation fluid into the completion string 24. Although just a handful of ICD 66 are depicted in FIG. 2, it will be appreciated that a well could have any suitable number of such ICD 66.

Figure 3:
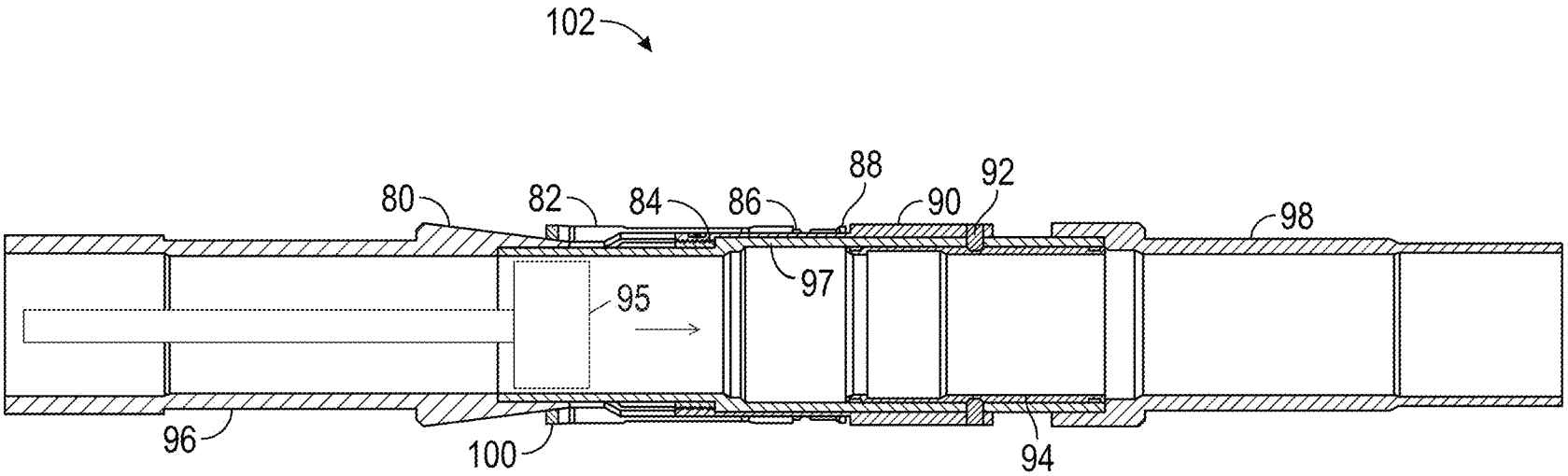
FIG. 3 is a cross-sectional diagram of the packer assembly of the steam injection system.

Turning now to FIG. 3, FIG. 3 is the packer assembly 68 of the steam injection system. The packer assembly is a shift set packer 102. The packer assembly 68 is positioned within the wellbore as part of the liner, as described above. Once the packer assembly 68 has reached the desired location within the wellbore, the packer assembly 68 can then be set by a setting tool 95. In one or more embodiments, the setting tool may be run downhole on coiled tubing or any other well-known conveyance.

The shift set packer 102 has a top sub 96, middle sub 97, and a bottom sub 98. The top sub 96 has a ramp 80. Sealing element 100 are positioned adjacent the ramp 80. The sealing element 100 are connected to a setting collet 82. The setting collet 82 and sealing elements 100 can travel up the ramp 80 when a force is applied to the setting collet 82. The setting collet 82 has a shear release tab 86 at the end of the setting collet 82. The shear release tab 86 is at the opposite end of the setting collet 82 from the sealing element 100.

The shift set packer 102 has an inner sleeve 94 and an outer sleeve 90. The inner setting sleeve 94 and an outer setting sleeve 90 are connected by a shear pin 92. The inner setting sleeve 94 has a circumferential profile. The setting tool 95 may engage the circumferential profile of the inner setting sleeve 94. The outer setting sleeve 90 has a spring 88 adjacent an outer surface of the outer setting sleeve 90. The spring 88 can be a wave spring or any other spring capable of creating a force. The shift set packer 102 has a ratchet 84 to lock the seal element 100 after the sealing element 100 has moved up the ramp 80.

To set the shift set packer 102, the setting tool connects to the circumferential profile of the inner setting sleeve 94. A force is applied by the setting tool causing the inner setting sleeve 94 and outer setting sleeve 90 connected by the shear pin 92 to slide along the middle sub 97. The force applied by the setting tool 95 will cause the outer setting sleeve 90 to contact the setting collet 82. The force will cause the setting collet 82 to convey the sealing element 100 up the ramp 80 of the top sub 96. The sealing element 100 will contact the wellbore wall creating a seal between the liner and wellbore wall. The ratchet mechanism 84 prevents the setting collet 82 and sealing element 100 from traveling down the ramp 80 once set. In other embodiments, additional or other methods of preventing the sealing element 100 from traveling down the ramp 80 may be utilized.

Once set, the packer assembly 68 isolates the portion of the wellbore below the packer assembly 68 from the portion of the wellbore above the packer assembly 68. During the SAGD process or after the SAGD process is completed, it may be desirable to unset the packer assembly 68. Unsetting the packer may be accomplished by actuating the packer assembly to shear a shear assembly that includes one or more shear pins. Additionally, the shear assembly includes the shear release tab 86 and spring 88. Once the shear assembly has sheared, the setting collet travels down the ramp, allowing the sealing element to travel down the ramp and, thus, unsetting the packer assembly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A packer assembly comprising:

a tubular body comprising:

a first sub comprising an outer surface having a ramp; and a middle sub disposed at least partially inside the first sub along the ramp;

a setting collet disposed about the middle sub;

a sealing element positioned adjacent the setting collet;

an outer setting sleeve disposed about the middle sub, wherein the outer setting sleeve is configured to move the setting collet in a first axial direction to force the sealing element along the ramp to expand the sealing element; and a ratchet disposed between the setting collet and the middle sub, wherein the ratchet is configured to block axial movement of the setting collet in a second axial direction away from the ramp.

2. The packer assembly of claim 1, further comprising an inner setting sleeve disposed at least partially inside the middle sub, wherein the middle sub is disposed radially between the inner and outer setting sleeves, and the inner and outer setting sleeves are coupled together via a shear pin extending through the middle sub.

3. The packer assembly of claim 2, wherein a setting tool connects to a circumferential profile of the inner setting sleeve.

4. The packer assembly of claim 3, wherein the setting tool applies a force to move the inner and outer setting sleeves together via the shear pin in the first axial direction relative to the middle sub to cause movement of the setting collet in the first axial direction.

5. The packer assembly of claim 1, further comprising a shear release tab disposed between the setting collet and the outer setting sleeve.

6. The packer assembly of claim 5, further comprising a spring disposed about the outer setting sleeve.

7. The packer assembly of claim 6, wherein the spring is disposed axially between the shear release tab and a shear pin, wherein the shear pin couples the outer setting sleeve to the middle sub.

8. The packer assembly of claim 1, wherein the packer assembly is configured to unset by actuating the packer assembly to shear a shear assembly, wherein the shear assembly includes a shear pin, a shear release tab, or any combination thereof.

9. The packer assembly of claim 1, wherein the tubular body comprises a second sub, wherein the middle sub is disposed at least partially inside the second sub.

10. The packer assembly of claim 9, wherein the first sub is a top sub and the second sub is a bottom sub.

11. The packer assembly of claim 9, wherein the tubular body comprises a central bore extending through the first sub, the middle sub, and the second sub, wherein a setting tool is configured to run through the central bore to actuate the outer setting sleeve.

12. The packer assembly of claim 11, further comprising an inner setting sleeve disposed at least partially inside the middle sub, wherein the setting tool is configured to move the inner setting sleeve to drive movement of the outer setting sleeve in the first axial direction.

13. The packer assembly of claim 12, wherein the ratchet is disposed radially between the setting collet and the middle sub, and the ratchet is disposed axially between the ramp and the inner setting sleeve.

14. A method of isolating zones on a steam injection system comprising:

setting a packer assembly within a wellbore;

wherein the packer assembly comprises:

a tubular body comprising:

a first sub comprising an outer surface having a ramp; and a middle sub disposed at least partially inside the first sub along the ramp;

a setting collet disposed about the middle sub;

a sealing element positioned adjacent the setting collet;

an outer setting sleeve disposed about the middle sub, wherein the outer setting sleeve is configured to move the setting collet in a first axial direction force the sealing element along the ramp to expand the sealing element; and a ratchet disposed between the setting collet and the middle sub, wherein the ratchet is configured to block axial movement of the setting collet in a second axial direction away from the ramp.

15. The method of claim 14, further comprising an inner setting sleeve disposed at least partially inside the middle sub, wherein the middle sub is disposed radially between the inner and outer setting sleeves, and the inner and outer setting sleeves are coupled together via a shear pin extending through the middle sub.

16. The method of claim 15, further comprising applying a force with a setting tool;

wherein the force causes the inner setting sleeve and the outer setting sleeve to slide together in the first axial direction relative to the middle sub.

17. The method of claim 16, wherein the force causes the outer setting sleeve to contact the setting collet and move the setting collet and the sealing element in the first axial direction.

18. The method of claim 16, wherein the force causes the setting collet and the sealing element to travel up the ramp creating a seal.

19. The method of claim 18, wherein an entirety of the sealing element is disposed along the ramp creating the seal.

20. The method of claim 15, further comprising shearing a shear assembly of the packer assembly to unset the packer assembly, wherein the shear assembly includes a shear pin, a shear release tab, or any combination thereof.

* * * * *